US006666797B1

(12) United States Patent
Martin

(10) Patent No.: US 6,666,797 B1
(45) Date of Patent: Dec. 23, 2003

(54) APPARATUS FOR THE SIMULATION OF SNOWBOARD USE

(76) Inventor: Daniel William Martin, P.O. Box 3992, Avon, CO (US) 81620

( * ) Notice: Subject to any disclaimer, the term of this patent is extended or adjusted under 35 U.S.C. 154(b) by 148 days.

(21) Appl. No.: 09/711,738

(22) Filed: Nov. 13, 2000

(51) Int. Cl.[7] ..... A63B 21/00; A63B 22/14
(52) U.S. Cl. ..... 482/51; 482/146
(58) Field of Search ..... 482/51, 52, 53, 482/79, 80, 146, 134, 135; 434/247

(56) References Cited

U.S. PATENT DOCUMENTS

| | | | | | |
|---|---|---|---|---|---|
| 2,964,315 | A | * | 12/1960 | Dinning | 482/71 |
| 3,361,427 | A | * | 1/1968 | Thomson et al. | 482/146 |
| 3,961,787 | A | * | 6/1976 | Studebaker et al. | 273/114 |
| 4,938,698 | A | | 7/1990 | Chantry | 434/253 |
| 4,966,364 | A | | 10/1990 | Eggenberger | 272/111 |
| D323,007 | S | | 1/1992 | Chantry | D21/191 |
| 5,135,249 | A | | 8/1992 | Morris | 280/609 |
| 5,152,691 | A | | 10/1992 | Moscarello | 434/247 |
| 5,203,279 | A | * | 4/1993 | Eversdyk | 119/712 |
| 5,312,258 | A | | 5/1994 | Giorgio | 434/253 |
| 5,399,140 | A | * | 3/1995 | Klippel | 482/146 |
| 5,545,115 | A | | 8/1996 | Corcoran | 482/146 |
| 5,643,164 | A | * | 7/1997 | Teff | 482/146 |
| 6,019,608 | A | | 2/2000 | Stark | 434/253 |

* cited by examiner

*Primary Examiner*—Stephen R. Crow
(74) *Attorney, Agent, or Firm*—Curtis V. Harr

(57) ABSTRACT

A snowboard training apparatus is provided which is designed to be used on any solid surface, such as a living room floor, and simulates the actual use of a snowboard on a ski hill. The training apparatus is made up of a plank-like board that roughly simulates a basic snow board. Additionally, the lower surface of the board is equipped with a pair of laterally mounted rockers that extend downward from this surface. These rockers are configured in a triangular shape and having the point of the triangle facing downward at the center of the rocker. This configuration ensures that when the board is placed on a hard surface it rests on the rockers which enables a user to learn to properly control a snowboard.

11 Claims, 3 Drawing Sheets

FIG 1
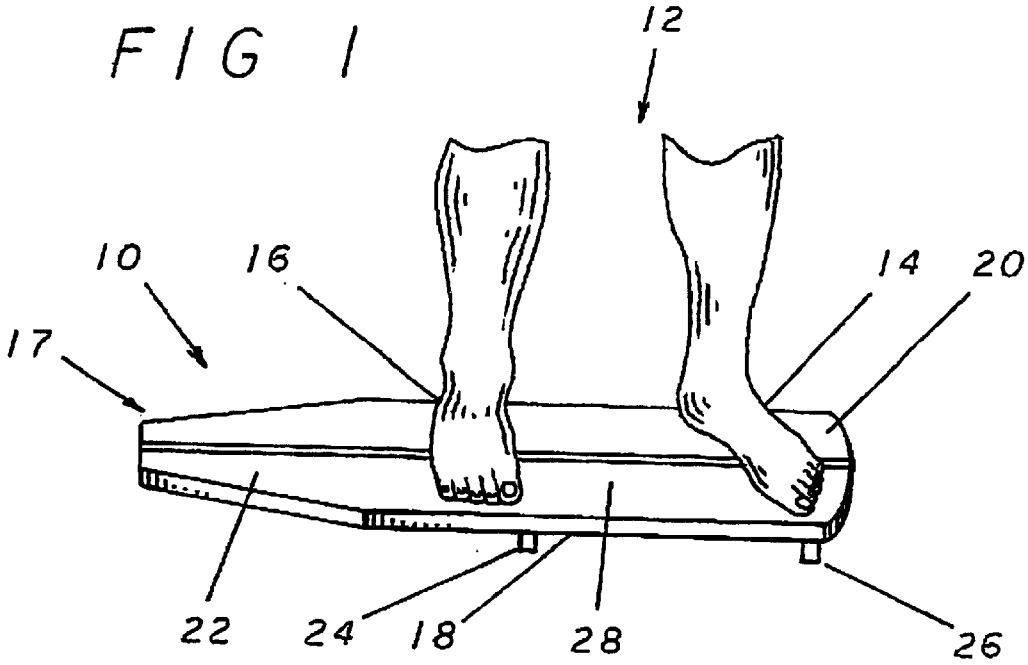
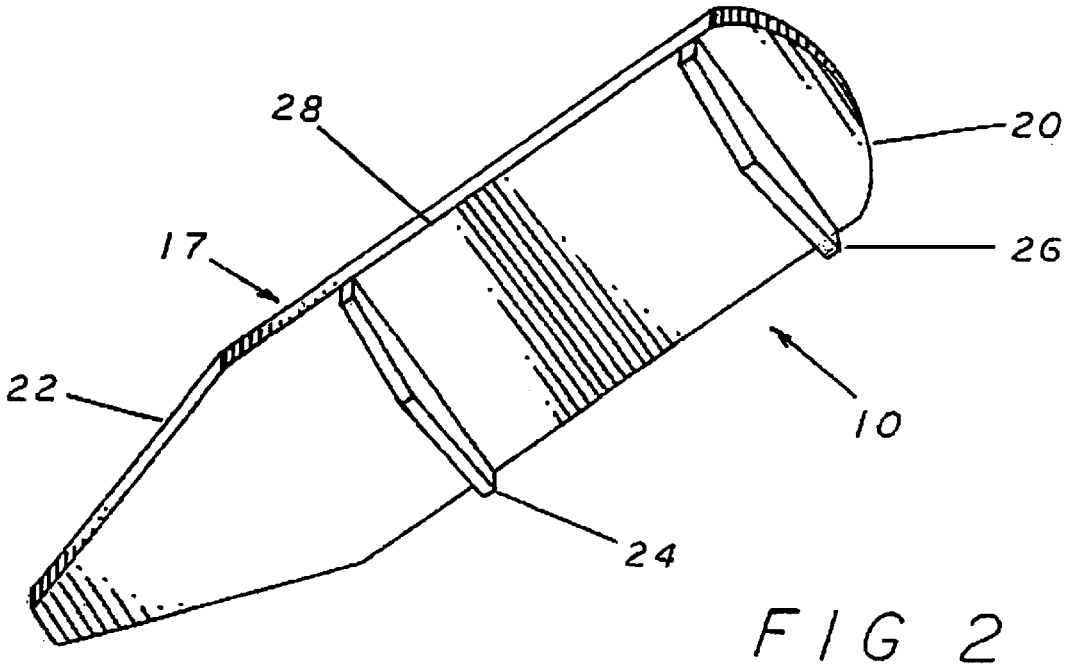
FIG 2

FIG 3
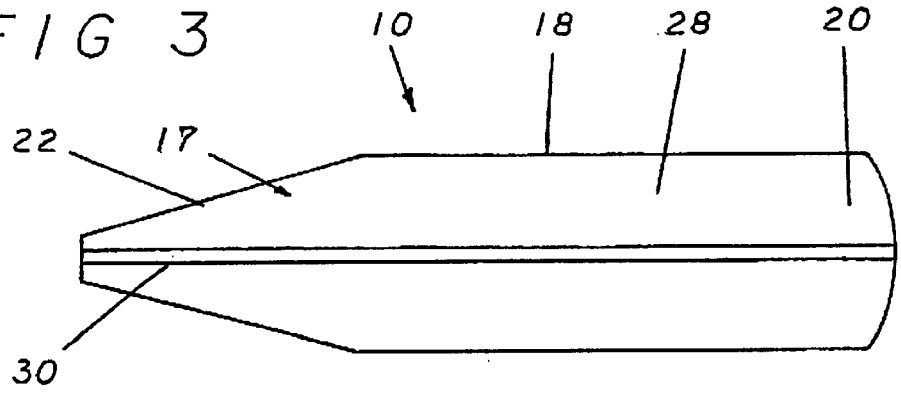
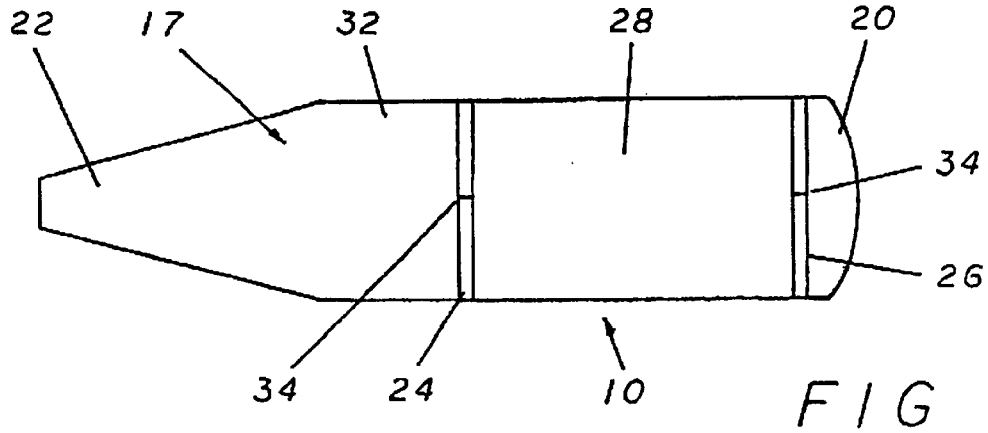
FIG 4
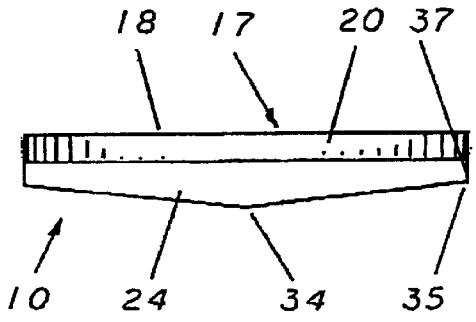
FIG 5
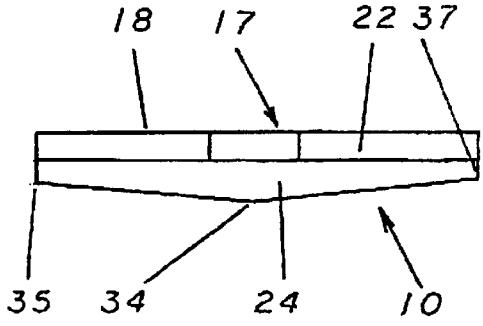
FIG 6

FIG 7
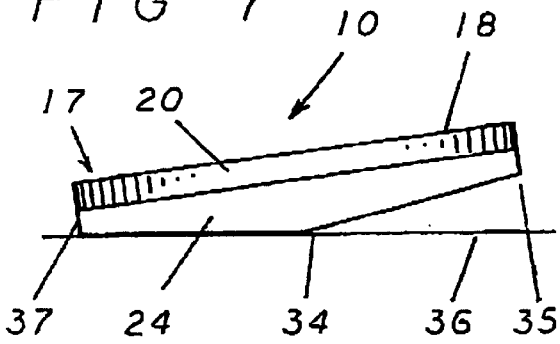
FIG 8
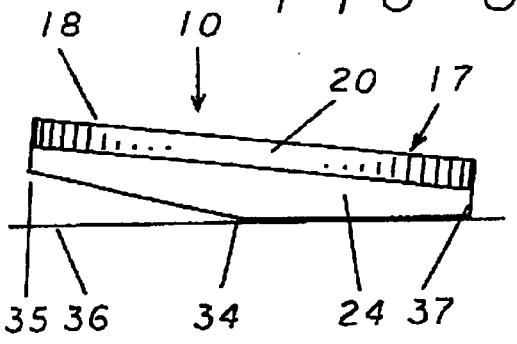
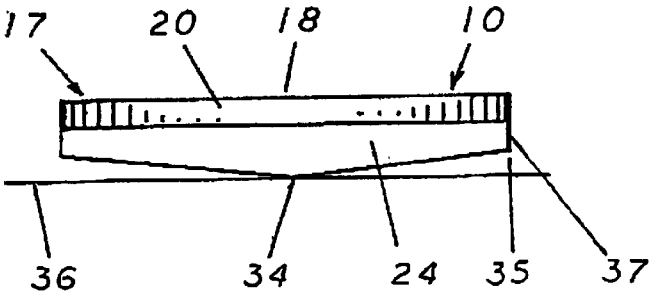
FIG 9
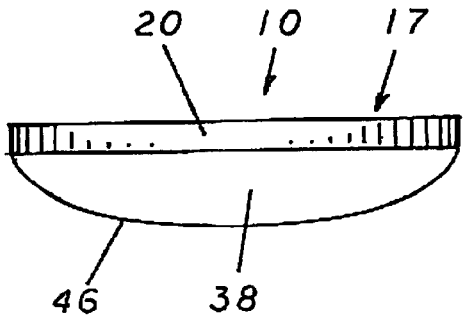
FIG 10
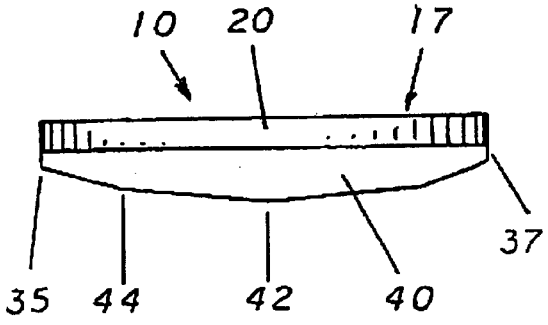
FIG 11

APPARATUS FOR THE SIMULATION OF SNOWBOARD USE

BACKGROUND OF THE INVENTION

The present invention relates generally to a balancing board apparatus. More specifically, the present invention relates to a snowboard simulator balancing board apparatus for closely simulating the act of snowboarding on dry land. The board is designed for practicing the balance and control movements necessary to effectively snowboard or carry out other related activities with similar methods of use.

Several apparatuses are known which have been used as dry land snowboard training devices. These devices use various mechanisms attempting to simulate actual snowboarding in real snow.

In the field of snowboard simulator balancing apparatuses, it has been well known to employ a board member or platform with various types of circular-shaped roller members thereunder. The user of the apparatus stands on the platform, feet apart, with the roller member positioned between the platform and the ground. The platform is often elongated and in a rectangular shape with rounded ends.

In these prior art apparatuses, the roller is placed underneath the board so that it's central axis is either perpendicular or longitudinal, depending on the respective design employed, to the longitudinal length of the board. In operation, the user places the platform on the roller and then stands on the platform with his or her feet being in a line which is substantially parallel to the longitudinal length of the platform. The roller is positioned below the platform with its central axis perpendicular or longitudinal to the line between the user's feet. To use the balancing board, the user rocks his or her body left to right to rock side-to-side on the roller in a see-saw-type fashion using the perpendicular roller, or front to back using the longitudinal roller.

U.S. Pat. No. 5,252,691 issued to Moscarello discloses a snowboard simulator balance apparatus which has a cylindrical roller that has an angled or tapered outer roller. The center of the roller has a large slot which allows it to engage a guide rail within the lower board surface. The board includes spacers between the upper and lower board surface.

U.S. Pat. No. 5,545,115 issued to Corcoran, discloses a snowboard simulator apparatus, which unlike U.S. Pat. No. 5,252,691, has a roller member running longitudinally along the board, which has two guide slots for engaging the guide or cross rails on the lower surface of the board. A pair of roller stop members, perpendicular to the guide rails, and located on the lower longitudinal edges of the board, prevent the escape of the longitudinally running roller from escaping laterally during use. The rolling travel of the member allows front-to-back action and pivot turn maneuvers experienced in actual snowboarding.

Additionally, other prior art methods have disclosed methods employing roller means other than the type of roller members discussed above. U.S. Pat. No. 4,966,364 issued to Eggenberger discloses a snowboard simulator board mounted on a cushion member which allows the stationary device to simulate tipping, sloping, and standing angles requiring acute balance in actual snowboarding. Between the cushion and the lower board surface is a bearing-type mechanism that allows the board to rotate on the cushion 360 degrees. A hard stop member is located on the nose end and a spring stop member on the tail end.

The prior art balancing boards have made attempts to improve the tracking and retention of a roller along its travel over the length of a balancing board. Various apparatuses have been attempted to achieve an improved fluid roll of a platform on a roller to further enhance performance. In addition, attempts have been made to ensure that the roller remains centered along the length of the board. Many of these apparatuses, or those incorporated by reference in the prior art disclose and further enhance the experience of a rocking side-to-side see-saw motion which is distinctly different than the motion actually experienced during snowboarding on real snow.

Additionally, boards with cushion members able to swivel 360 degrees or ball bearing methods attachable beneath simulated boards or in combination with actual boards, have been disclosed. However, no method in the prior art has employed different shaped rocking members at various positions within a simulated balancing board to more closely simulate the experience and motion of actual snowboarding when moving side to side.

Due to the demand for a snowboard simulator which can closely simulate snowboarding on real snow, it is desirable for a simulator apparatus to mimic the actual movement and experience of actual snowboarding. It is also desirable to have a snowboard simulator apparatus which can simulate as many different types of maneuvers and tricks which can be executed on a real snowboard on actual snow.

As can be seen from this discussion, it would be desirable to have a practice board simulator balancing apparatus for dry land use that allows the most realistic simulation of actual snowboarding on real snow. This balancing apparatus must be designed to be able to closely simulate the forward downslope, and pivoting and turning movements experienced during snowboarding in a simple and reliable fashion.

SUMMARY OF THE INVENTION

It is the primary objective of the present invention to provide a method by which an individual can improve the skills necessary to control a snowboard without actually having to be at a ski hill.

It is an additional objective of the present invention to provide a method which allows potential snowboarders to practice and master these skills within the confines of their own homes.

It is a further objective of the present invention to provide such a method without having to incur the expenses that are normally associated with the process of learning to master the use of a snowboard.

These objectives are accomplished by the use of a snowboard training apparatus which is designed to be used on any solid surface, such as a living room floor, and simulates the actual use of a snowboard on a ski hill. The training apparatus is made up of a plank-like board that roughly simulates a basic snowboard. Additionally, the lower surface of the board is equipped with a pair of laterally mounted rockers that extend downward from this surface. These rockers are configured in a triangular shape and having the point of the triangle facing downward at the center of the rocker. This configuration ensures that when the board is placed on a hard surface it rests on the rockers.

The training apparatus is employed by a user by placing it rockers down on a floor and mounting it by placing his back foot on the tail end of the board behind the rearmost rocker. This positioning of the back foot and placing one's weight on it lifts the front end of the board off the floor. The mounting process is then completed by placing one's forward foot on the forward end of the board directly over the front rocker. From this position, the user then bends his front knee and ankle thereby placing the majority of his weight on this front foot. This has the effect of forcing the front of the board down to come in contact with the floor and raising the rear off of the floor. Once these initial steps have been accomplished, the user obtains his neutral balance position over the center of the plank and it is this position upon which all other movements associated with the control of an actual snowboard are based.

From the neutral balance position the user can practice his balance and control over the orientation of the trainer. The key to the use of the present invention is learn how to make and control the small body movements that are essential in controlling a snowboard. Specifically, the use of the present invention allows the operator to learn that he can change the orientation of the board in relation to the rockers and their respective rocker points by manipulating his weight over the board. These changes in body position are exactly the same as those required to properly control a snowboard on a ski hill and so the unique design characteristics of the invention allow an individual to learn new or improve on existing snowboarding skills.

For a better understanding of the present invention reference should be made to the drawings and the description in which there are illustrated and described preferred embodiments of the present invention.

DESCRIPTION OF THE DRAWINGS

FIG. 1 is a perspective view of the present invention which illustrates the manner in which an individual places his feet on the upper surface of the trainer in order to practice the skills necessary to master the use of a snowboard.

FIG. 2 is a perspective view of the present invention illustrating the manner of construction of the lower surface of the trainer and specifically detailing the form and orientation of the board rockers.

FIG. 3 is a top elevation view of the present invention illustrating the general manner of construction of the training apparatus.

FIG. 4 is a bottom elevation view of the present invention illustrating its general manner of construction and the location of the board rockers.

FIG. 5 is a front elevation view of the present invention illustrating the relative size of the board rockers in relation to the forward end of the trainer.

FIG. 6 is a side elevation view of the present invention illustrating the relative size of the board rockers in relation to the tail end of the trainer.

FIG. 7 is a front elevation view of the present invention illustrating the orientation of the trainer when weight is positioned over its right side.

FIG. 8 is a front elevation view of the present invention illustrating the orientation of the trainer when weight is positioned over its left side.

FIG. 9 is a front elevation view of the present invention illustrating the orientation of the trainer when weight is positioned over its center.

FIG. 10 is a front elevation view of an alternative embodiment of the present invention in which the board rocker is designed to have an elliptical contact surface.

FIG. 11 is a front elevation view of an alternative embodiment of the present invention in which the board rocker is designed to have a multi-stepped contact surface.

DESCRIPTION OF THE PREFERRED EMBODIMENT

Referring now to the drawings, and more specifically to FIGS. 3, 4, 5, and 6, the snowboard training apparatus 10 is made up of a generally flat plank 17 which is intended to closely approximate the size and feel of a real snowboard. The plank 17 itself is made up of the upper board surface 18 which provides the surface that the user engages to use the present invention. The upper board surface 18 is made up of three separate areas, the forward board end 20, the board mid-section 28, and the board tail end 22. The practical distinction between these three areas of the plank 17 is that the orientation of the plank 17 can be greatly effected by focusing the user's weight in differing ways within them. In fact, this is the exact manner that one employs to control the direction of travel and the speed of a real snowboard.

The lower board surface 32 provides the point of attachment for the rear board rocker 24 and the front board rocker 26. The rear and front board rockers, 24 and 26, are mounted laterally across the width of the lower board surface 32 and extend downward therefrom. The rear and front board rockers, 24 and 26, are mounted in positions which generally separate the board tail end 22 from the board mid-section 28 in the case of the rear board rocker 24 and the board mid-section 28 from the forward board end 20 in the case of the front board rocker 26. This positioning of the rear and front board rockers, 24 and 26, is pivotal to the use of the present invention as it effects the balance of the plank 17 during its use.

Additionally, the rear and front board rocker, 24 and 26, are constructed in such a manner so that they are essentially downwardly oriented triangles having the tips, or rocker points 34, of these triangles being at the furthest point from the point of attachment of the rear and front board rockers, 24 and 26, to the lower board surface 32. The triangle portions of the rear and front board rockers, 24 and 26, are extended away from the lower board surface 32 by the rocker sides 37. The rocker sides 37 help to lift the invention off of the practice surface 36 which enhances the effectiveness of the invention's motion during training sessions.

The configuration of the rear and front board rockers, 24 and 26, mean that their rocker points 34 are the primary points of contact between the invention and the surface upon which it is being used. The rear and front board rockers, 24 and 26, also have two rocker edges 35 which essentially form the outer edges of the triangular shape of these components. These rocker edges 35 form the point of the rear and front board rockers, 24 and 26, that keep the invention as a whole from rotating beyond. That is to say, the rockers edges 35 keep the plank 17 from pivoting too far to either side and therefore make the invention more stable and safer for people of limited snowboarding experience and ability.

The manner in which a snowboard user 12 employs the present invention to learn or practice their technique is further illustrated in FIGS. 1 and 2. The present invention is employed by a snowboard user 12 by placing its rear and front board rockers, 24 and 26, down on a practice surface 36 and placing his trailing foot 16 on the board tail end 22 on the upper board surface 18 just behind the rear board rocker 24. This positioning of the trailing foot 16, and the corresponding placement of one's weight on it, lifts the forward board end 20 off the practice surface 36. The mounting process is then completed by placing one's lead foot 14 on the forward board end 20 directly over the front board rocker 26.

From the above described position, the snowboard user 12 then bends his front knee and ankle which has the effect of placing the majority of his weight on his lead foot 14. This forces the forward board end 20 down which in turn makes the front board rocker 26 come in contact with the practice surface 36 and raises the board tail end 22 off of the practice surface 36. Once these initial steps have been accomplished, the snowboard user 12 obtains a neutral balance position over the center of the plank 17 and it is this position upon which all other movements associated with the control of an actual snowboard are based.

From the neutral balance position, the snowboard user 12 can practice his balance and control over the orientation of the invention's plank 17. The manner in which these changes effect the orientation of the present invention in relation to the practice surface 36 are further illustrated in FIGS. 7, 8, and 9. These FIGS. illustrate the manner in which rear board rocker's 24 orientation can vary from having the rocker edge 35 on one side of the rear board rocker 24 being in contact with the practice surface 36 to having only the rocker point 34 in contact with it to having the rocker edge 35 on the other side of the rear board rocker 24 in contact with the practice surface 36. Additionally, it is important to note that these illustrated principles applied to the rear board rocker 24 apply equally to the operations of the front board rocker 26.

The key to the use of the present invention is learn how to make and control the small body movements that affect these positions in relation to the practice surface 36 that are essential in controlling a snowboard on a ski hill. These changes in body position are exactly the same as those required to properly control a snowboard on a ski hill and so the unique design characteristics of the invention allow an individual to learn new or improve on existing snowboarding skills without incurring the expenses or dangers of actually going to a ski hill.

An alternative embodiment of the present invention is illustrated in FIG. 10 in which an elliptical rocker 38 is employed instead of the triangular shaped rockers described above. The only difference in this embodiment to that as described above is that the rocker point 34 and rocker edges 35 of the previous embodiment have been replaced by a continuous elliptical rocker surface 46 which is the point of contact for the invention with the practice surface 36. This design means that the invention's plank 17 can be continually rotated from side to side in a smooth and even manner without changing the effectiveness of the present invention and thus, provides an alternative for those users who desire it.

An additional alternative embodiment of the present invention is illustrated in FIG. 11 in which stepped rocker 40 is employed as opposed to the elliptical rocker 38 or the triangular shaped rockers described above. The distinguishing feature of this embodiment of the invention is that it has not only a centrally located primary rocker point 42, but also has a pair of secondary rocker points 44. These secondary rocker points 44 are located on either side of the primary rocker point 42 just outside of the midpoint between the primary rocker point 42 and the rocker edges 35. This design provides two more specific points of balance in the secondary rocker points 44 which can be a helpful training aid for some users. Additionally, this design also does not change the overall effectiveness of the invention as to its primary purpose.

Although the present invention has been described in considerable detail with reference to certain preferred versions thereof, other versions are possible. Therefore, the spirit and scope of the appended claims should not be limited to the description of the preferred versions contained herein.

What is claimed is:

1. A practice snowboard training apparatus comprising:

an elongate body having an upper surface, a lower surface, a circumferential edge, a forward board end and a board tail end integrally formed therein, said elongate body having a length substantially greater that its width, said elongate body further having a width which tapers inward to a flat section so as to form said board tail in a V with a cut flat bottom shape; and a rocker member fixedly located on the lower surface of said elongate body, said rocker member being positioned within said circumferential edge so as to span said width of said elongate body, said rocker member having a left and right end and a center portion wherein said center portion and said left and right end extend perpendicular to said elongate body and said center portion of said rocker extends a perpendicular length greater than said right and left end.

2. A practice snowboard training apparatus as in claim 1 wherein said forward board end is substantially rounded.

3. A practice snowboard training apparatus as in claim 1 wherein said rocker member shape is triangular.

4. A practice snowboard training apparatus as in claim 1 wherein said rocker member has an elliptical lower surface.

5. A practice snowboard training apparatus as in claim 1 wherein said rocker member has a lower stepped surface with three rocker points.

6. A snowboard training apparatus comprising:

an elongate body having an upper surface, a lower surface, a circumferential edge, a forward board end a middle section and a board tail end integrally formed therein, said elongate body having a length substantially greater that its width, said elongate body further having a width which tapers inward to a flat section so as to form said board tail in a V with a cut flat bottom shape;

a front rocker member fixedly located on the lower surface of said elongate body substantially near said forward board end, said rocker member being positioned within said circumferential edge so as to span said width of said elongate body; and a rear rocker member fixedly located on the lower surface of said elongate body substantially near said middle section of said elongate body, said rocker member being positioned within said circumferential edge so as to span said width of said elongate body.

7. A snowboard training apparatus as in claim 6 wherein said front and rear rocker members each have a left and right end and a center portion wherein said center portions and said left and right ends extend perpendicular to said elongate body and said center portions of said rockers extends a perpendicular length greater then said right and left ends.

8. A snowboard training apparatus as in claim 7 wherein said forward board end is substantially rounded.

9. A snowboard training apparatus as in claim 7 wherein said rocker members shape is triangular.

10. A snowboard training apparatus as in claim 7 wherein said rocker members have an elliptical lower surface.

11. A snowboard training apparatus as in claim 7 wherein said rocker member have a lower stepped surface with three rocker points.

* * * * *